US005110135A

United States Patent [19]

Weber

[11] Patent Number: 5,110,135

[45] Date of Patent: May 5, 1992

[54] CARD GAME

[75] Inventor: Fred Weber, Schaffhausen, Switzerland

[73] Assignee: AGM Aktiengesellchaft Müller, Neuhausen, Fed. Rep. of Germany

[21] Appl. No.: 659,265

[22] Filed: Feb. 22, 1991

[51] Int. Cl.[5] ..... A63F 1/06; B42D 15/02

[52] U.S. Cl. ..... 273/296; 273/148 A; 229/92.8; 229/147; 229/152

[58] Field of Search ..... 273/296, 302, 243, 240, 273/269, 148 A, 293; 229/92.8, 147, 152

[56] References Cited

U.S. PATENT DOCUMENTS

| | | | |
|---|---|---|---|
| 2,101,355 | 12/1937 | Wonder | 229/147 |
| 2,876,012 | 3/1959 | Allen | 229/92.8 |
| 4,140,317 | 2/1979 | Ramney | 273/243 |
| 4,285,520 | 8/1981 | Small | 273/269 |
| 4,601,490 | 7/1986 | Brandon | 273/240 |

*Primary Examiner*—Benjamin Layno

*Attorney, Agent, or Firm*—Spencer, Frank & Schneider

[57] ABSTRACT

In a card game, the folding box and/or individual or every playing card thereof are provided with a printed form corresponding to the address part of a postcard or parcel. Thereby, the card game or the individual playing cards thereof are made directly accessible to mailing by post and sent as a vehicle for sending greetings, advertising media, a gift and the like.

7 Claims, 1 Drawing Sheet

CARD GAME

BACKGROUND OF THE INVENTION

The present invention relates to a card game.

Since the 14th century, card games have been known in Europe. They not only serve the purpose of relaxation and entertainment, but demand from the player common sense, self-control and imagination, improve thinking power and the power of concentration and develop the sense of numbers. In addition to this, card games are often of artistic merit, and make articles that are suitable as presents or souvenirs.

SUMMARY OF THE INVENTION

Therefore, a primary object of the present invention is to create a card game that completely differs in its conception from that of the usual card games in order to take the afore-mentioned points more into account.

This is achieved according to the invention in that the folding box thereof and/or individual or every playing card thereof is provided with a printed form corresponding to the address part of a postcard or parcel.

Thus, card games or playing cards are created which are suitable for being posted directly and which, apart from the original function thereof as instruments for games, can, in addition, be used as a means of sending specific greetings, advertising media and as gifts, among other things.

For this, a further advantageous refinement can be seen therein that the one lateral insert flap of the folding box is enlarged more than the length of said box in order to overlap one surface of said box when said insert flap is in the folded-over state, the free end thereof being intended for insertion into the slot in the area of the other insert flap of said folding box, wherein, then, said enlarged insert flap has the address part on the outside thereof Further, it is of advantage that individual or every playing card thereof is developed as a picture postcard.

BRIEF DESCRIPTION OF THE DRAWINGS

Exemplary embodiments of the invention will now be more particularly described with reference to the accompanying drawings in which.

DETAILED DESCRIPTION OF THE PREFERRED EMBODIMENTS

Figure 1:
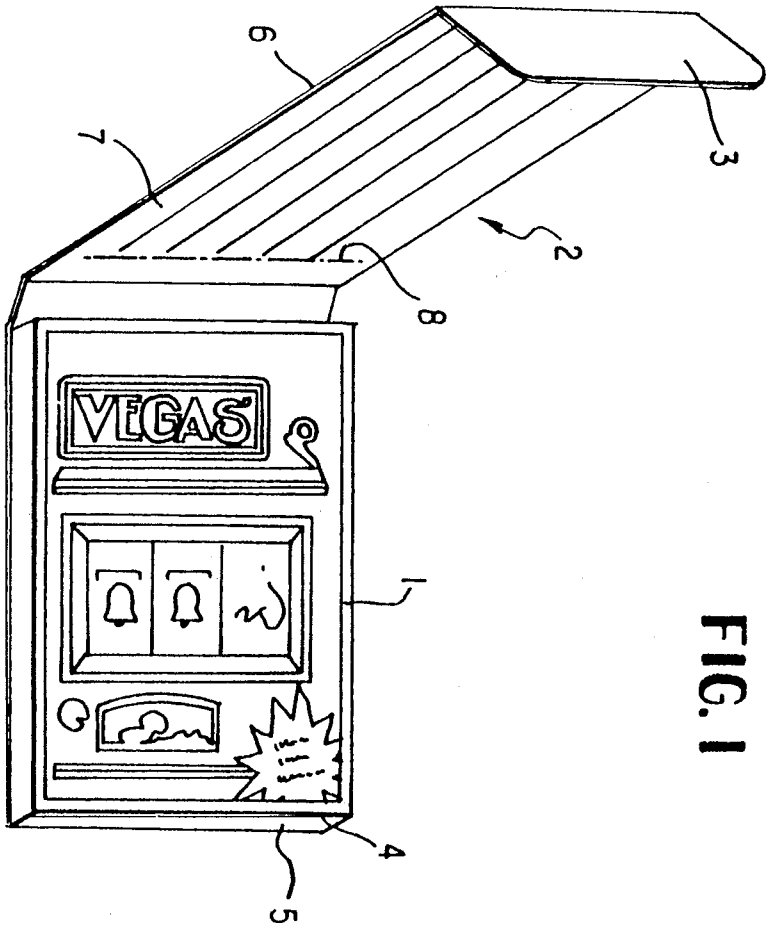
FIG. 1 is a schematic representation of a card game box suitable for mailing by post.

According to FIG. 1, the card game box 1 is developed in customary manner, except that the one lateral insert flap 2 is enlarged more than the length of the box in order to overlap one surface of the box when the insert flap is in the folded-over state, the free end 3 forming at this stage the flap which is insertable into the slot 4 existing in the area of the other insert slot 5 of the folding box 1.

Figure 2:
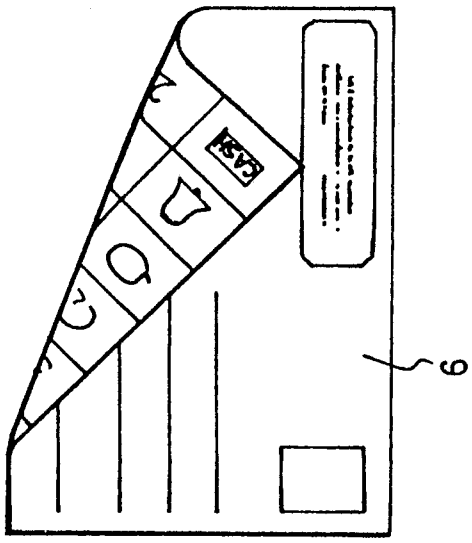
FIG. 2 is a schematic representation of a playing card of a card game suitable for mailing by post.

Externally 6, the flap 2 is provided with a printed form corresponding to the address part of a postcard or a parcel (FIG. 2). Internally 7, the flap 2 may serve as the inscription field for information or messages of the sender. Thereby, it is possible for the user to make card games developed in such manner easily accessible for mailing by post.

For the subsequent usage, the flap 2 can be cut along the dot-dash line 8 and used in the customary manner for the closure of the box.

In the embodiment according to FIG. 2, it is advantageous that each playing card 9 of a card game is provided with a printed form on the reverse side thereof, allowing thereby the playing cards to be used directly as postcards or picture postcards.

This creates completely new possibilities of an additional usage of playing cards. In this connection, it is completely insignificant what card game is concerned, provided that the individual cards of the respective game have plain reverse sides which are suited for the imprint of an address part corresponding to that of a postcard. Of requirement is, moreover, a size of the respective individual cards accessible to postcard mailing. This restriction does not usually apply to parcel post, so that the size of card games or boxes according to FIG. 1 is insignificant Card games that are suitable for sending by post according to FIG. 1, and playing cards of a card game developed as postcards or picture postcards according to FIG. 2 provide, beyond the actual practical value of card games, new possibilities of use as presents, souvenirs, means of sending greetings, means of advertising etc. Furthermore, the cards may bear cooking recipes with text and pictures.

While there are shown and described preferred embodiments of the invention, it is to be distinctly understood that the invention is not limited thereto but may be embodied and practised within the scope of the following claims. Accordingly,

What I claim is:

1. A card game having at least one playing card and a folding box for holding the at least one playing card, the folding box having at least one foldable lateral insert flap attached thereto at one end and at least one slot, wherein:

a printed form for address information is provided on a surface of said at least one lateral insert flap;

said at least one lateral insert flap extends more than the length of said folding box thereby overlapping one lengthwise surface of said folding box when said at least one lateral insert flap is in a folded-over state, a free end of said at least one lateral insert flap being insertable into the at least one slot at an opposite end of the folding box from where said at least one lateral insert flap is attached; and said printed form for address information is provided on said at least one lateral insert flap on an outside surface thereof when in a folded-over state.

2. A card game as defined in claim 1, wherein at least one playing card is designed as a picture postcard.

3. A card game as defined in claim 1, further comprising a plurality of cards designed to make up a collection for cooking recipes each so designed card being printed on at least one side thereof with text and picture for a recipe.

4. A card game as defined in claim 3, wherein at least one cared is provided on one side thereof with a printed form for address information in the form of a postcard.

5. A card collection having at least one recipe card and a folding box for holding the at least one recipe card, the folding box having at least one foldable lateral insert flap attached thereto at one end and at least one slot, wherein:

a printed form for address information is provided on a surface of said at least one lateral insert flap;

said at least one lateral insert flap extends more than the length of said folding box thereby overlapping one lengthwise surface of said folding box when said at least one lateral insert flap is in a folded-over state, a free end of said at least one lateral insert flap being insertable into the at least one slot at an opposite end of the folding box from where said at least one lateral insert flap is attached; and said printed form for address information is provided on said at least one lateral insert flap on an outside surface thereof when in a folded-over state.

6. The card collection of claim 5, comprising a plurality of recipe cards making up a collection of cooking recipes each of said cards being printed on at least one side thereof with text and picture for a recipe.

7. The card collection as defined in claim 5, wherein at least one recipe card is provided on one side thereof with a printed form for address information in the form of a postcard.

* * * * *